US007600357B2

(12) United States Patent
Jörissen et al.

(10) Patent No.: US 7,600,357 B2
(45) Date of Patent: Oct. 13, 2009

(54) BEVERAGE CAN FILLING PLANT FOR FILLING, CLOSING, AND PACKING BEVERAGE CANS AND A METHOD OF OPERATION THEREOF

(75) Inventors: Michael Jörissen, Bedburg-Hau (DE); Alexander Brüker, Kalkar (DE); Thomas Nitsch, Kleve (DE); Josef Düpper, Bedburg-Haus (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 315 days.

(21) Appl. No.: 11/535,697

(22) Filed: Sep. 27, 2006

(65) Prior Publication Data

US 2007/0084149 A1 Apr. 19, 2007

(30) Foreign Application Priority Data

Sep. 28, 2005 (DE) ..... 10 2005 046 246

(51) Int. Cl.
*B65B 35/54* (2006.01)

(52) U.S. Cl. ..... 53/157; 53/543; 53/448

(58) Field of Classification Search ..... 53/443, 53/445, 448, 155, 156, 157, 535, 543
See application file for complete search history.

(56) References Cited

U.S. PATENT DOCUMENTS

| | | | | | |
|---|---|---|---|---|---|
| 2,615,289 | A * | 10/1952 | Hickin | 53/445 |
| 2,864,212 | A * | 12/1958 | Bruce | 53/398 |
| 3,190,048 | A * | 6/1965 | Ganz | 53/445 |
| 3,651,614 | A * | 3/1972 | Corderoy | 53/474 |
| 3,680,278 | A * | 8/1972 | Pearson | 53/445 |
| 3,848,519 | A * | 11/1974 | Ganz | 493/312 |
| 3,863,427 | A * | 2/1975 | Rossi | 53/382.2 |
| 3,872,647 | A * | 3/1975 | Langen et al. | 53/157 |
| 3,924,385 | A * | 12/1975 | Walter | 53/48.1 |
| 4,236,855 | A * | 12/1980 | Wagner et al. | 414/789.5 |
| 4,763,462 | A * | 8/1988 | Johnson et al. | 53/448 |
| 4,829,747 | A * | 5/1989 | Johnson et al. | 53/457 |
| 4,878,337 | A * | 11/1989 | Raudat et al. | 53/534 |
| 4,962,625 | A * | 10/1990 | Johnson et al. | 53/157 |
| 5,438,815 | A * | 8/1995 | Fleuren | 53/398 |
| 5,454,211 | A * | 10/1995 | Ziegler et al. | 53/458 |
| 5,485,713 | A * | 1/1996 | Moncrief | 53/445 |
| 5,626,002 | A * | 5/1997 | Ford et al. | 53/398 |
| 5,713,403 | A * | 2/1998 | Clusserath et al. | 141/101 |
| 5,761,882 | A * | 6/1998 | Gambetti | 53/445 |
| 5,862,648 | A * | 1/1999 | Greenwell et al. | 53/445 |
| 6,990,786 | B2 * | 1/2006 | Kilmartin | 53/411 |
| 7,302,785 | B2 * | 12/2007 | Heuvel et al. | 53/445 |
| 2004/0068961 | A1 * | 4/2004 | Chalendar et al. | 53/398 |

FOREIGN PATENT DOCUMENTS

| | | |
|---|---|---|
| DE | 2356319 A1 | 5/1975 |
| DE | 30 33 773 A1 | 5/1982 |

* cited by examiner

*Primary Examiner*—Paul R Durand
(74) *Attorney, Agent, or Firm*—Nils H. Ljungman & Associates

(57) ABSTRACT

A method of operating a beverage can packaging station in which the filled closed cans in a group of cans are individually spaced apart from one another at a distance sufficient to permit the lowering of a divider into the spaces between the individual cans substantially only by gravity.

4 Claims, 9 Drawing Sheets

VIEW A-A

BEVERAGE CAN FILLING PLANT FOR FILLING, CLOSING, AND PACKING BEVERAGE CANS AND A METHOD OF OPERATION THEREOF

BACKGROUND

1. Technical Field

The present application relates to a beverage can filling plant for filling, closing, and packing beverage cans and a method of operation thereof. The present application further relates to a method for the manufacture of container packages and for the packing of containers in container carriers such as outer boxes, for example, and a device for the performance of the method.

2. Background Information

This application thereby relates, to cite just one exemplary embodiment, to container packaging formats that have a box-shaped receptacle made of a cut blank of foldable flat material with corresponding side walls, whereby the receptacle container can be open on top. These container packages also have internal partitions that are made of a wide cut blank of foldable flat material which, when folded out, form corresponding cell dividers or honeycombs to protect the individual containers against impact and during transport of the containers to be packaged. This protection during transport of the containers to be packaged can also comprise a plurality of cut blanks that are assembled to form cell dividers or honeycombs.

German Patent No. 23 56 391 A1 describes a method for the opening of folded cell dividers and for the insertion of the opened cell dividers into container packaging, whereby the folded cell dividers are transported upright into a first position, from which they are moved forward by means of a transport device that applies a suction force, are then opened and transported into a second position above the containers. They are then fixed in this second position and finally pushed into the opened container package.

During the transfer of the cell dividers from the first position into the second position, the cell dividers are opened by a 90° pivoting of a transport device that is operated by a suction force. The opened cell divider is then inserted partway into a container package and is finally pushed by a vertically movable push-down ram or stamp to the bottom of the container package. Apart from the multiple steps that are required for the positioning and insertion of a cell divider, a further significant disadvantage is that these work steps, which must be performed in sequence, can be performed only in discontinuous operation of the machine.

For this purpose, German Patent No. 30 33 773 A1 describes, among other things, a method for the manufacture of container carriers and for the packing of containers in these container carriers. In this method of the prior art, separately manufactured flat cut blanks for a container carrier and for a partition insertion are fed to a packing machine. The partition insert, which can be prefabricated or fabricated in the packaging plant, is folded to form cell divider fields and is then brought together with a group of containers. The folded partition insert is then inserted from overhead onto a pre-arranged group of containers. In practice, the method is carried out so that groups of containers are pushed onto the bottom of container carrier cut blanks lying flat, and then the box cell dividers with folded-out transverse webs are placed from above between the rows of the groups of containers. Then the side walls of the container carrier cut blank are folded against the long sides of the containers. The end-side connecting tabs of the center walls and the end walls of the container carrier cut blanks are then folded against the transverse sides of the containers and are glued together. The final step is carried out at a right angle to the direction of transport.

The prior art also includes devices that are capable of extracting the partitions, cell dividers or honeycombs, all folded flat, one after the other by means of the gripper device of a loading or charging unit which transports the honeycombs in the horizontal direction, opens them and then transfers them to a vertical device, by means of which the opened honeycomb can be inserted into a carton that is designed to hold bottles or similar objects. Devices of this type have the disadvantage that the honeycombs, which are generally made of cardboard, can be damaged during the transfer from one device to another. The entire cycle also requires a very long time between the pickup of the honeycombs and their insertion into the carton, because a certain length of time is necessary for the horizontal movement between the devices. Finally, extreme care is necessary to ensure accurate positioning between the devices for the horizontal and vertical movement, because otherwise the machine has to be turned off.

Finally, the prior art indicates that the erection, transfer and insertion process can be performed in continuous operation. For this purpose, a device is used for the extraction of a partition or of a cell divider that is folded flat, and for the opening and insertion of the cell divider into a container package or a carton, which device has an individual gripper apparatus by means of which an L-shaped movement can be carried out with the simultaneous opening of each cell divider and a lowering into the carton that takes place under the force of gravity. The final lowered position of the box cell dividers positioned between the bottles, cans or similar objects is then reached by means of vibration devices or vibrating conveyors. One disadvantage of this method is the uncontrolled transfer of a cell divider simply by letting it fall. At high production rates in particular, it repeatedly occurs that the cell dividers tip over onto the bottle formations, with corresponding disruptions of machine operation. Such interruptions occur frequently in practice when the cell dividers have to be fitted over groups of containers, the containers of which do not have a well-defined neck area which generally promotes the introduction of the cell dividers. Well-defined neck areas are found on wine bottles, for example, as a result of which the partitions can be inserted particularly easily and smoothly in cases of wine bottles. By contrast, the introduction of cell dividers in groups of beverage cans such as beer cans, for example, is particularly difficult and susceptible to disruptions, because cans have only a narrow edge (the flanged edge) in the vicinity of their covers, which makes a direct transition into the vertical outside wall, and the cans within a container group are arranged right one up against another, i.e. outside wall in contact with outside wall, which makes the introduction of cell dividers even more difficult.

OBJECT OR OBJECTS

The object of at least one possible embodiment is to essentially eliminate or minimize the disadvantages described above, and consequently to make possible a fast and disruption-free introduction of the cell dividers into a group of containers while the machine is in continuous operation.

SUMMARY

The present application teaches that this object can be accomplished by arranging the containers of a container group for the insertion of the cell dividers, so that the containers are at a defined distance from one another. Special guide elements are provided for the purpose.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The application is described in greater detail below with reference to the exemplary embodiments that are illustrated in the accompanying drawings. In the drawings:

FIG. 1 is a side view of a device of the prior art for the introduction of cell dividers into a group of containers consisting of rows of containers;

FIGS. 3-3*d* illustrate the various phases of the insertion of cell dividers 13 into a group of containers, viewed in the direction opposite to the direction of transport;

DESCRIPTION OF EMBODIMENT OR EMBODIMENTS

Figure 1A:
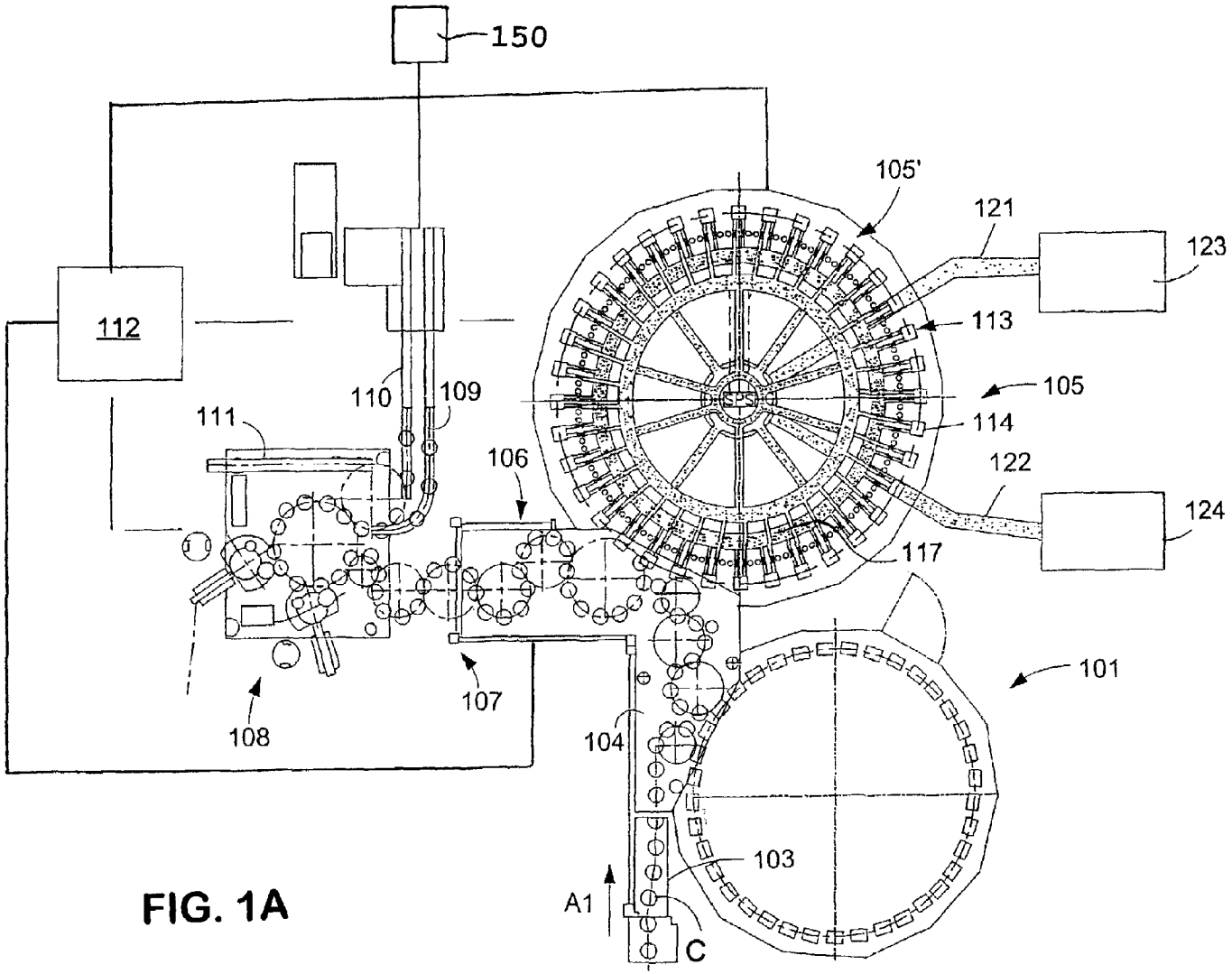
FIG. 1A is a schematic illustration of a container filling plant in accordance with one possible embodiment.

FIG. 1A shows schematically the main components of one embodiment example of a system for filling containers, specifically, an embodiment of a beverage container filling plant 100 for filling containers C, such as cans for beer or soft drinks, with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely containers C, are fed in the direction of travel as is indicated by the arrow A1, by means of a conveyer line or conveyer arrangement to feed containers to rinsing arrangement 103, and downstream of rinsing arrangement or rinsing station 101, in the direction of travel as is indicated by the arrow A1, the rinsed containers C are transported to a beverage filling machine 105 by means of a conveyer line or conveyer arrangement 104 to pass containers to the filling machine that is formed, for example, by a starwheel conveyer or a plurality of starwheels of a conveyer arrangement. The conveyer arrangement 104 to pass containers to filling machine may possibly comprise a starwheel conveying structure that introduces containers C to the filling machine 105.

Downstream of the filling machine 105, in the direction of travel of the containers C, there can preferably be a closing arrangement or closing station 106 which closes the containers C.

The closing arrangement or closing station 106 can, for example, be connected directly to an optional labeling arrangement or labeling station 108 having at least one labeling unit, device, or module for first product, each unit having a head, such as, for example, by means of a conveyer arrangement 107 to pass containers to labeling arrangement that may be formed, for example, by a plurality of starwheels of a conveyer arrangement.

In the illustrated embodiment, the labeling arrangement or labeling station 108 having at least one labeling unit, device, or module for first product, each unit having a head has, for example, three outputs, namely one output formed by a conveyer arrangement 109 to convey first product containers for containers C that are filled with a first product. The first product may possibly be provided by a first product mixer 123 that is connected to the filling machine 105, for example, through a conduit for first product 121, and containers C that are filled with a predetermined volume of liquid beverage filling material, that is, the first product, are then labeled by a labeling module in the labeling arrangement or labeling station 108 having at least one labeling unit, device, or module for first product, each unit having a head, corresponding to this first product delivered from first product mixer 123 to the beverage filling machine 105 and thence to the corresponding containers C.

A second output that is formed by a conveyer arrangement 110 to convey second product containers is provided for those containers C that are filled with a second product. The second product may emanate from a second product mixer 124 that is connected, for example, through a conduit for second product 122 to the filling machine 105, and these containers C filled with a predetermined volume of liquid beverage filling material comprising the second product are then correspondingly labeled by a labeling module in the labeling arrangement or labeling station 108 having at least one labeling unit, device, or module for first product, each unit having a head, corresponding to this second product.

A third output, for example, formed by a conveyer arrangement 111 to convey incorrectly labeled containers, removes any containers C which have been incorrectly labeled as may have been determined by an inspecting device or an inspecting station, or an inspecting module that may possibly form a part of the labeling arrangement or labeling station 108 having at least one labeling unit, device, or module for first product, each unit having a head.

In at least one possible embodiment of the beverage container filling plant, the labeling station 108 can be omitted as the containers C could be preprinted or marked cans that would not require a label or further marking.

After the containers have been filled, closed, and labeled or otherwise marked or printed on, the containers are moved by the conveyor arrangements 109, 110 to a packing or packaging section 150 of the plant. In the packing section 150, the containers are arranged in groups and transported by a conveyor arrangement. The groups of containers can then be divided by dividers placed between the individual containers as described herein, and then packaged in boxes.

In FIG. 1A item 112 is a central control arrangement or, expressed differently, a controller with a computer to process algorithms, which controls the operation of the above-referenced system or plant. The beverage filling machine 105 is preferably of the revolving design, with a rotor 105', which revolves around a vertical machine axis. The rotor 105' is designed to handle the containers C by the neck. A filling arrangement 114 having at least one filling device, element, apparatus, or valve, comprises an apparatus configured to introduce a predetermined volume of liquid beverage filling material into the interior of containers C to a predetermined level of liquid beverage filling material. Furthermore, the filling device or apparatus comprises an apparatus configured to terminate the filling of containers upon liquid beverage filling material reaching the predetermined level in containers C. In other words, the filling arrangements 114 having at least one filling device, element, apparatus, or valve, are configured and disposed to provide a predetermined flow of liquid beverage filling material from the source thereof, such as, product mixers 123 and 124, into the containers C.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product.

As well as the more typical filling machines having one toroidal vessel, it is possible that in at least one possible embodiment a filling machine could possibly be utilized wherein each filling arrangement 114 having at least one filling device, element, apparatus, or valve is preferably connected by means of two connections to a toroidal vessel 117 which contains a first product, say by means of a first connection, for example, the conduit for first product 121, and to a second toroidal vessel which contains a second product, say by means of the second connection , for example, the conduit for second product 122. In this case, each filling arrangement 114 having at least one filling device, element, apparatus, or valve can also preferably have, at the connections, two individually-controllable fluid or control valves, so that in each container C which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Before the cell dividers 13 are fed to a group of containers, the group of containers must first be formed from a stream of containers flowing to the packing machine. The containers 14 are initially fed to the packing machine in a wide track and without any particular organization. Inside the packing machine the containers 14 are first lined up in chutes formed by rails or partition plates, as a result of which rows of containers are formed. Then the desired number of containers are extracted from the chutes, at the end of which process the next group of containers to be packed is formed. Then, by way of example, the cell divider is fed to this group of containers, after which there is a compacting of the containers, i.e. a reduction of the distances between the containers 14, and the actual packing takes place.

Figure 2:
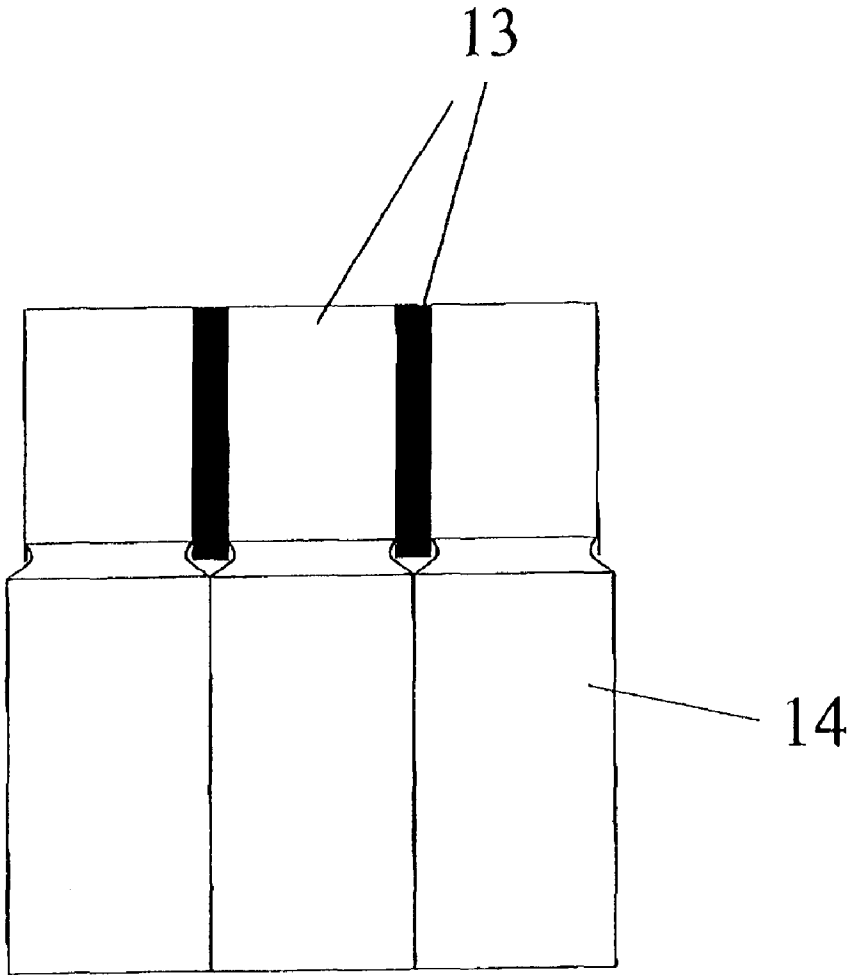
FIG. 2 is an illustration of containers 14 without a well-defined neck area.

As illustrated in FIG. 1, on devices of the prior art the cell dividers lying flat are extracted from the storage magazine, opened and moved, preferably in a horizontal plane above the plane of movement of the group of containers and/or of an outer box, and in this position are delivered to a cell divider centering and lowering device, and are then lowered by this device onto a group of containers, for example, whereupon the cell dividers are inserted into the group of containers in the desired manner by the force of gravity alone. The problems that thereby occur on devices of the prior art are illustrated schematically in FIG. 2. It is obvious that the cell dividers 13 that comprise cut blanks arranged transversely and longitudinally cannot then be easily introduced between the containers 14 when the containers are right up against one another, e.g. cans, unless these containers 14 have a well-defined neck area. To further explain, the defined, elongated, large neck areas of bottles and other similar containers act essentially as guides to guide a divider between adjacent bottles when the divider is fed or driven into position between the bottles. Cans on the other hand generally do not have elongated or enlarged neck areas and are generally cylindrical in shape with substantially flat tops that have substantially the same diameter as the body of the can. The shape of the cans therefore does not act as a guide for a divider being fed in between the cans. The close proximity of the tops of the cans produces a very small space in which a divider could be inserted. Such a small space leaves very little room for error in inserting a divider as any deviation in the course of movement of the divider or positioning of the cans would result in the divider being driven into the top of at least one of the cans. The divider would not be able to move any further and would either jam the machine or result in one or more cans being knocked over, which are extremely undesirable situations in high speed filling machines where every lost second of operation increases costs. Therefore, in order to introduce a divider in between cans or similar containers that do not have elongated or enlarged or otherwise well-defined neck areas, it is advantageous to space the containers apart from one another, such as described herein.

The containers lined up one after another, viewed in the direction of transport, are called a row or a container row. At least one possible embodiment now teaches that the individual rows of containers are arranged at a distance from each other in the vicinity of the location of the feed and insertion of the box cell dividers 13 into the group of containers. For this purpose, between the rows of containers there is a guide that runs in the direction of transport and extends along the conveyor line, at least from the beginning of the feed and/or insertion of the cell dividers, to or on the group of containers, until the cell dividers have been sufficiently inserted into the group of containers. A first configuration of this application provides that the guides 15 that are located between the individual rows of containers surround, pick up and guide the components of the cell dividers 13 that are being inserted on both sides at least partly. The guides preferably comprise two side elements which are located at a distance from each other and thus form a narrow guide track or guide chute 16 for the cell dividers. This method makes it possible for the cell dividers 13 to be inserted into the group of containers unhindered by transverse forces exerted on them from the outside. On the devices of the prior art, these transverse forces can be or are caused, for example, by impacts among the containers, the compacting of the group of containers and/or by undesirable transverse movements of the containers.

Figure 3:
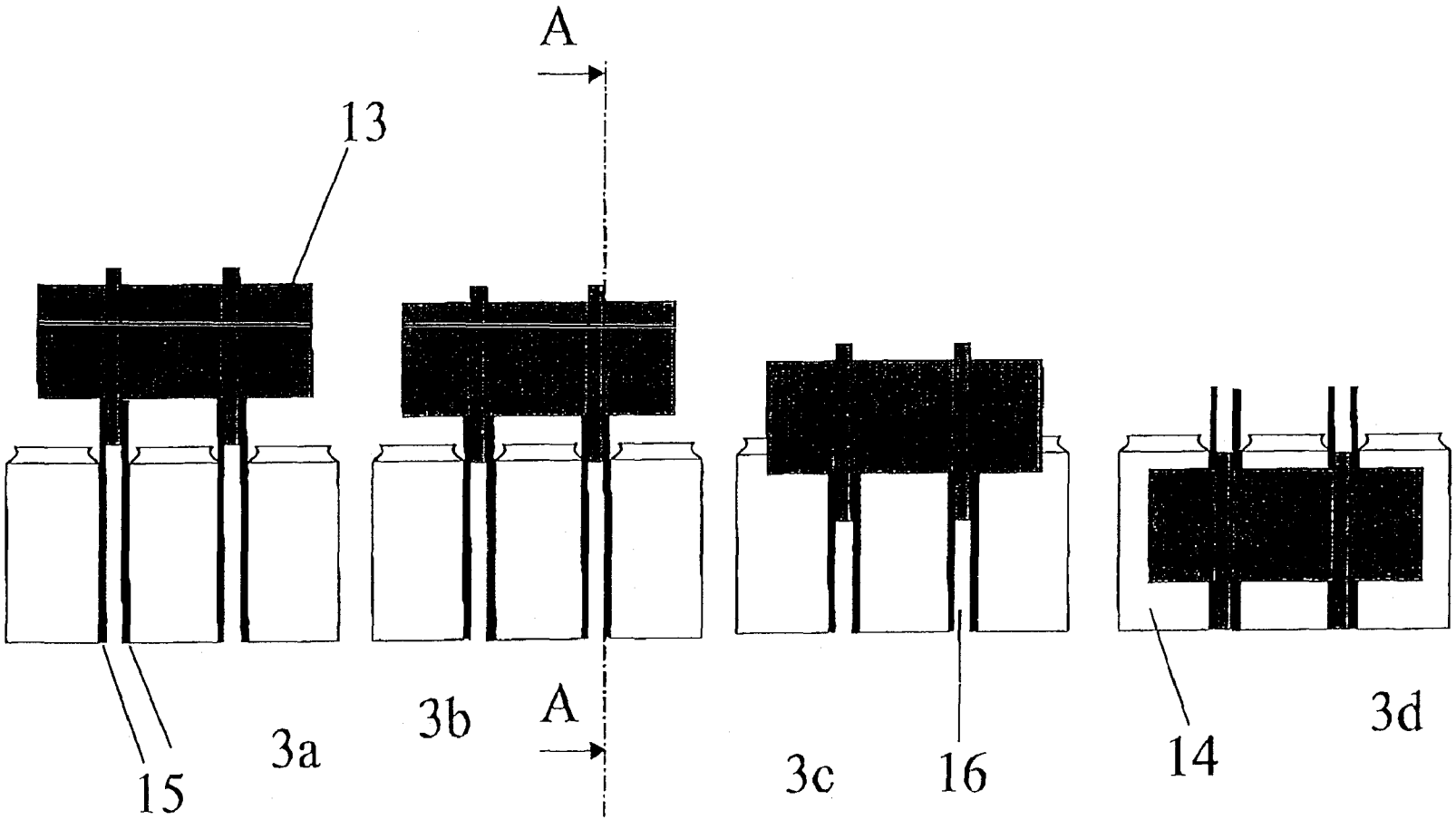

One such exemplary embodiment of the application is illustrated in FIG. 3, whereby the cell dividers are to be moved toward the observer from the view shown. The individual details 3*a*, 3*b*, 3*c* and 3*d* show individual phases of the insertion of the cell dividers 13 into the group of containers. As can be seen in FIG. 3, each of the guides 15 are comprised of pairs of fins or guide webs with a space in between to accept the lower portion of the divider webs that run parallel to the guide space. The divider webs that are positioned transverse to the guides 15 sit on top of the guides 15, as can be clearly seen in FIG. 4.

Figure 4:
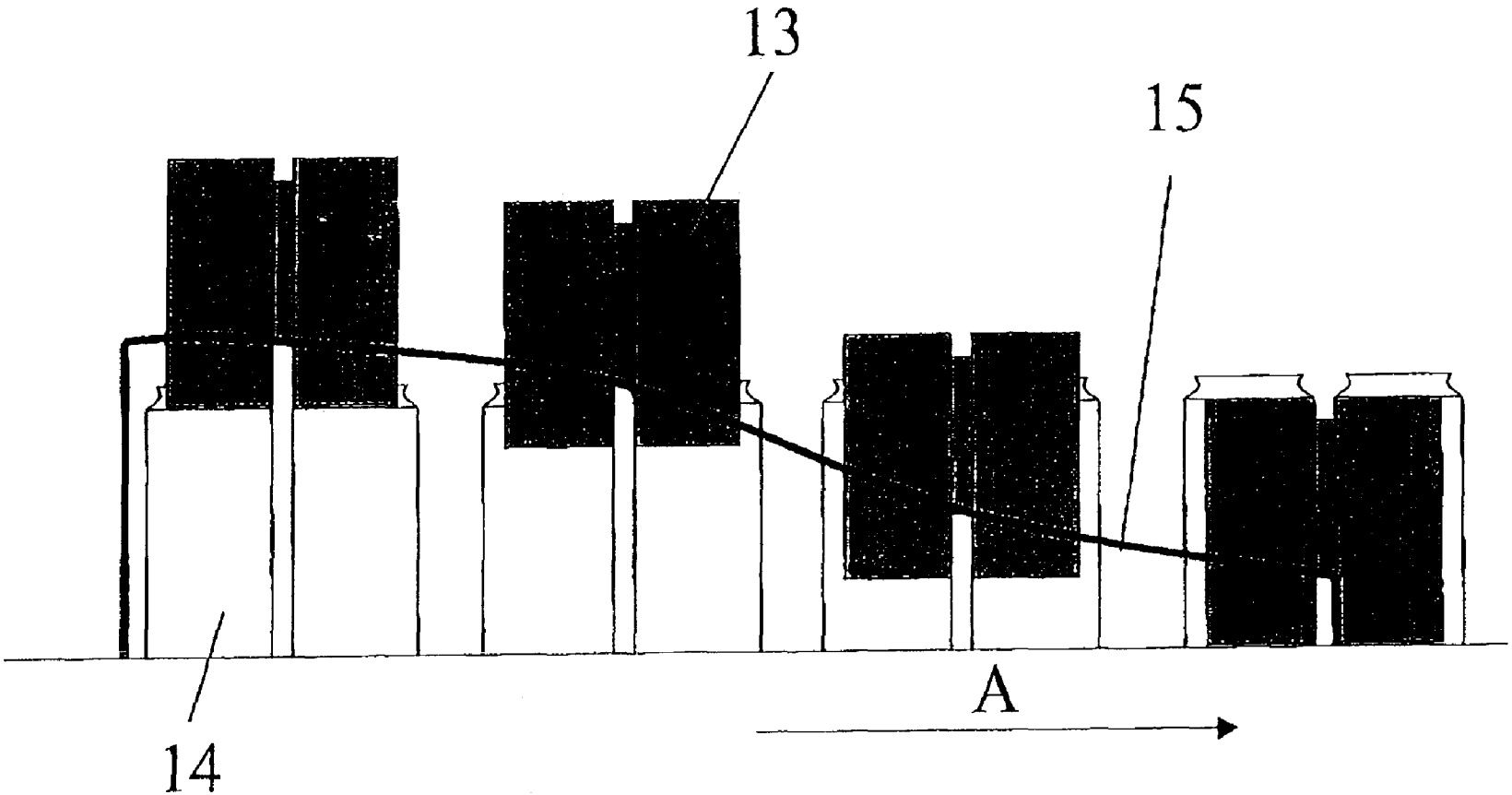
FIG. 4 likewise illustrates the various phases of the insertion, viewed in a direction at a right angle to the direction of transport.

FIG. 4 shows comparable phases of the insertion of the cell dividers in a view that is at a right angle across the direction of transport A. The width of the guide chutes 16 must be designed so that the cell dividers can be easily inserted into the chutes without additional force. The upper edges of the guides 15 form a stop for the cross-braces of the cell dividers 13 and thus have an effect on their downward movement. Once the cell dividers 13 have been inserted into the group of containers, either completely or at least far enough that the rest of the insertion can proceed without problems, the guides 15 end. The rows of containers are now at a sufficient distance from one another that the subsequent compacting of the group of containers is indispensable. After this compacting, the final packing of the group of containers can take place, e.g. with an outer box formed by folding. Above the groups of containers, there can also be a guide that runs in the direction of transport and or an accompanying active (driven by a motor) or passive (driven by the moving product) push-down unit, which assists the downward movement of the cell dividers 13, which occurs essentially by gravity, by striking the divider cells 13 as they move forward in the direction of transport A, and thus pushes them farther into the group of containers.

Figure 5:
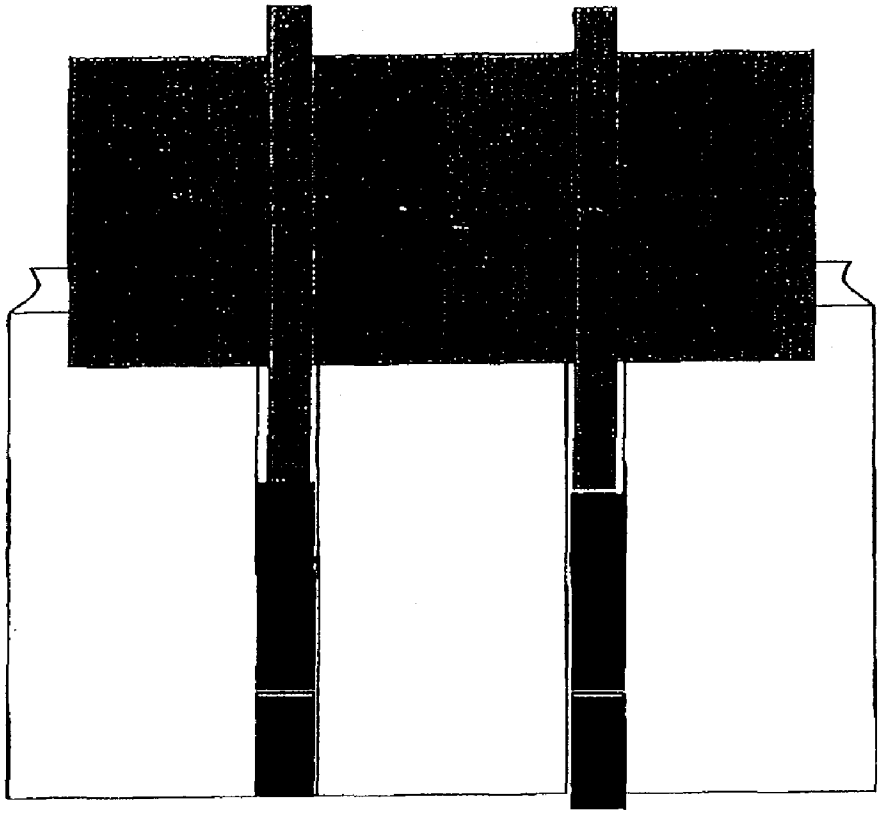
FIG. 5 shows an additional configuration of this at least one possible embodiment.

In a second configuration of this application, the guides 15 are realized in a simplified manner. One corresponding exemplary embodiment of the application is illustrated in FIG. 5. At least one possible embodiment teaches that the guides are realized so that they do not form a guide chute 16 for the cell dividers 13, but a guide track 17, with which the components of the cell dividers, oriented in the direction of transport, are in at least partial contact. The width of the guide track 17 is preferably designed so that the track brings the containers 14 to a distance from one another so that the cell dividers 13 can be inserted into the group of products with no significant clearance, and so that after the removal of the guide 15, there is no need for a subsequent compacting of the group of products.

In an additional configuration of this application, the guide 15 that is located between the rows of containers is used only to bring the rows of containers to a specified minimum distance from one another, but beyond that does not form any guide for the control of the insertion movement of the cell dividers 13 into the group of containers. This objective can be accomplished, for example, by running the guide 15, viewed in the direction of transport A, essentially in a single height plane. A configuration of this type can be realized particularly economically.

Figure 7:
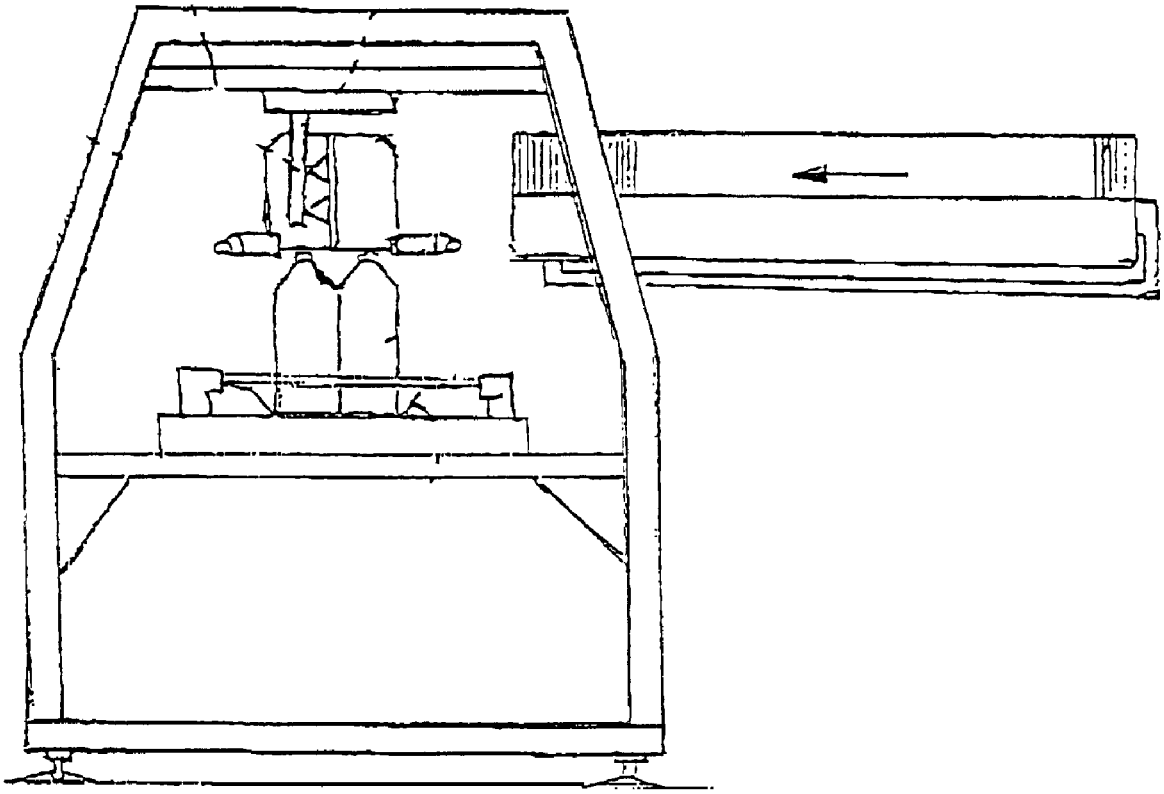
FIG. 7 shows a side view of the embodiment shown in FIGS. 6-6C.
Figure 6:
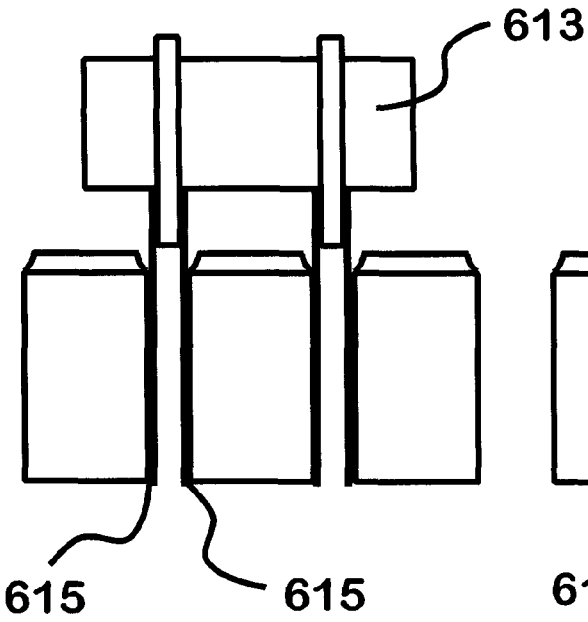
FIGS. 6-6C show a view of an embodiment similar to FIG. 3.
Figure 6A:
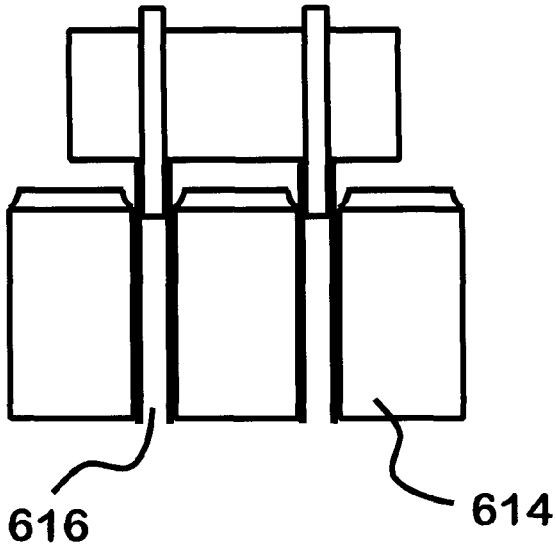
Figure 6B:
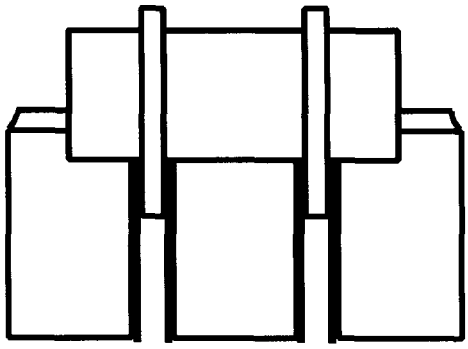
Figure 6C:
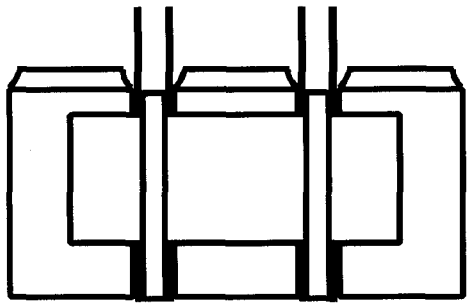
Figure 7:
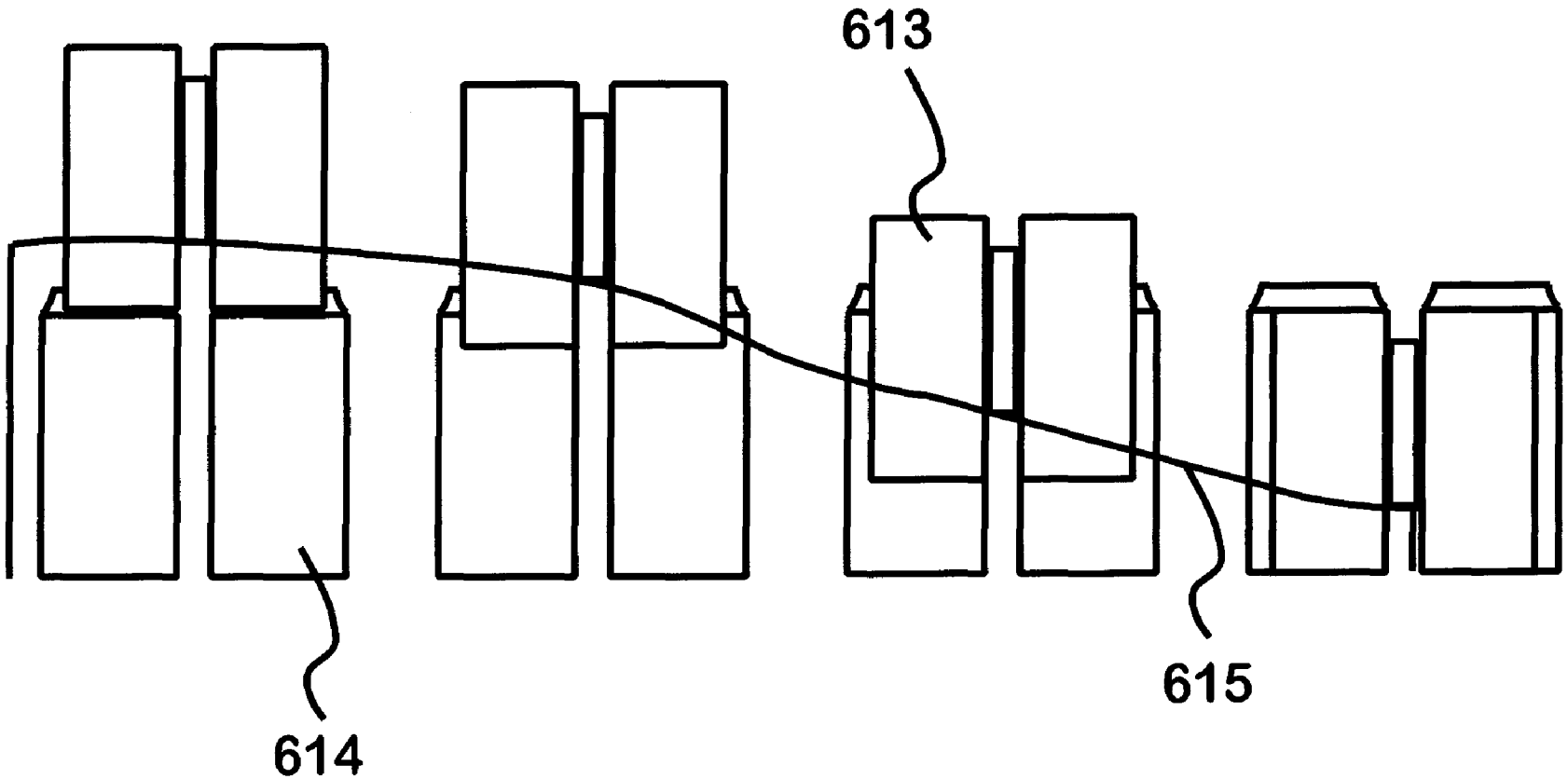

FIGS. 6-6C show a view of an embodiment similar to FIG. 3. Guides 615, cell dividers 613, and containers 614 are shown. FIG. 7 shows a side view of the embodiment shown in FIGS. 6-6C.

Figure 8:
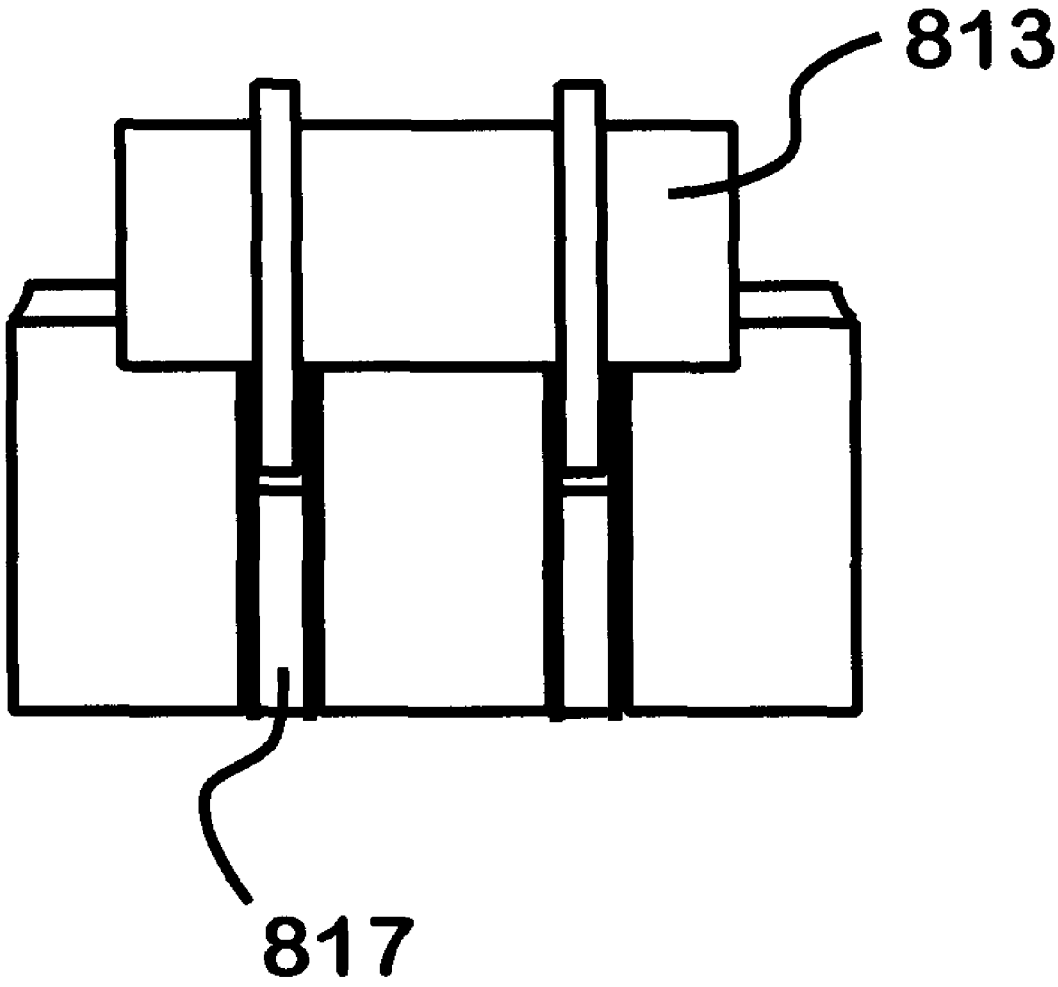
FIG. 8 shows a view of an embodiment similar to FIG. 5.

FIG. 8 shows a view of an embodiment similar to FIG. 5. Guides 817 and cell divider 813 are shown.

For packaging the groups of containers after they have been divided by a divider, an open box can be placed over the top of the group and then flipped over and sealed, then flipped again to return the containers to the upright position.

The present application relates to a method and a device for the manufacture of container packages and for the packing of containers such as bottles, cans and similar objects in outer boxes with separating inserts or cell dividers that can be inserted between the containers, which cell dividers can be extracted from a storage magazine and can be inserted into the spaces in a group of containers, whereby the containers are arranged in rows in the packing machine, and teaches that the individual rows of containers of a group of containers to which the cell dividers are to be fed are placed at a minimum distance from one another, then the cell dividers are fed to the group of containers, and then the components of the cell dividers oriented in the direction of transport are inserted into the minimum distance created between the rows of containers. It goes without saying that at least one possible embodiment can also be used on containers that have a well defined neck area.

An example of a packing container sold under the trademark name "Brik-Pak" can be found in U.S. Pat. No. 4,287,247, entitled "Packing laminate provided with crease lines." Machines for assembling and filling the Brik-Pak containers are made by Tetra Pak, Inc. of Vernon Hills, Ill.

The components disclosed in the various publications, disclosed or incorporated by reference herein, may possibly be used in possible embodiments of the present application, as well as equivalents thereof.

Some examples of partition inserters which may possibly be utilized or adapted for use in at least one possible embodiment may include the ZPI-400 for inserting corrugated partitions made by Moen Industries, 12333 Los Nietos Rd., Santa Fe Springs, Calif. 90670; the SF-400 Partition Inserter by Wayne Automation Corporation, 605 General Washington Ave., Norristown, Pa. 19403; the Model 70 partition opener/inserter by A-B-C Packaging Machine Corporation, 811 Live Oak Street, Tarpon Springs, Fla. 34689; and the YH1400 partition inserter by Pearson Packaging Systems, 8120 West Sunset Highway, Spokane, Wash. 99224. Another example of a partition inserter may possibly be found in U.S. Pat. No. 5,600,936, entitled "Suspended modular partition inserter."

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of shrink wrapping machines or machines for wrapping items in plastic film which may possibly be utilized or adapted for use in at least one possible embodiment may possibly be found in the following U.S. Patents: U.S. Pat. No. 6,826,893, entitled "Apparatus for wrapping products with plastic film;" U.S. Pat. No. 6,739,115, entitled "Equipment for wrapping groups of products in plastic film;" U.S. Pat. No. 5,878,555, entitled "Apparatus for wrapping articles in plastic film;" U.S. Pat. No. 5,787,691, entitled "Apparatus for wrapping articles in plastic film;" U.S. Pat. No. 5,519,983, entitled "Shrink wrap packaging system with an ultrasonic side sealer;" U.S. Pat. No. 4,956,963, entitled "Method of sealing a shrink wrap package;" U.S. Pat. No. 4,873,814, entitled "Method of making a shrink wrap package;" U.S. Pat. No. 4,214,419, entitled "Collating and shrink wrap packaging apparatus;" U.S. Pat. No. 6,484,475, entitled "Modular packaging machine;" U.S. Pat. No. 4,694,633, entitled "Film wrapping machine;" U.S. Pat. No. 4,118,916, entitled "Thermoplastic wrapping machine;" U.S. Pat. No. 4,118,916, entitled "Thermoplastic wrapping machine;" U.S. Pat. No. 5,371,999, entitled "Shrink film wrapping machine;" U.S.

Pat. No. 4,748,795, entitled "Film wrapping machine;" and U.S. Pat. No. 5,115,620, entitled "Wrapping machine."

The appended drawings in their entirety, including all dimensions, proportions and/or shapes in at least one embodiment of the application, are accurate and are hereby included by reference into this specification.

Some examples of beverage bottling systems which may possibly be utilized or adapted for use in at least one possible embodiment may possibly be found in the following U.S. Patents, and are hereby incorporated by reference as if set forth in their entirety herein: U.S. Pat. No. 6,494,238, entitled "Plant for filling beverage into beverage bottles and other beverage containers having apparatus for replacing remaining air volume in filled beverage bottles or other beverage containers;" U.S. Pat. No. 6,474,368, entitled "Beverage container filling machine, and method for filling containers with a liquid filling material in a beverage container filling machine;" U.S. Pat. No. 6,470,922, entitled "Bottling plant for bottling carbonated beverages;" U.S. Pat. No. 6,463,964, entitled "Method of operating a machine for filling bottles, cans or the like beverage containers with a beverage, and a beverage container filling machine;" U.S. Pat. No. 6,374,575, entitled "Bottling plant and method of operating a bottling plant;" U.S. Pat. No. 6,365,054, entitled "Plant for filling containers and a method for operating a plant for filling containers," U.S. Pat. No. 6,192,946, entitled "Bottling system;" U.S. Pat. No. 6,189,578, entitled "Filling system and filling element;" U.S. Pat. No. 6,058,985, entitled "Bottling machine with a set-up table and a set-up table for a bottling machine and a set-up table for a bottle handling machine;" U.S. Pat. No. 5,713,403, entitled "Method and system for filling containers with a liquid filling product, and filling machine and labelling device for use with this method or system," U.S. Pat. No. 5,634,500, entitled "Method for bottling a liquid in bottles or similar containers;" and U.S. Pat. No. 5,413,153, entitled "Container filling machine for filling open-top containers, and a filler valve therefor."

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefassen an Gefassfullmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

U.S. patent application Ser. No. 11/009,551, entitled "Beverage Bottling Plant for Filling, Closing, and Packing Beverage Bottles", filed on Dec. 10, 2004, having inventors Robert VAN DER HEUVEL, et al. is hereby incorporated by reference as if set forth in its entirety herein.

The corresponding foreign and international patent publication applications, namely, Federal Republic of Germany Patent Application No. 10 2005 046 246.4, filed on Sep. 28, 2005, having inventors: Michael JÖRISSEN, Alexander BRÜKER, Thomas NITSCH, and Josef DÜPPER and German Laid Open Patent Application No. 10 2005 046 246.4 and German Patent No. 10 2005 046 246.4, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The Innopack packaging machine, manufactured by KHS Maschinen und Anlagenbau AG, is an example of a packaging machine which may possibly be utilized or adapted for use in at least one possible embodiment. Some other examples of packaging machines and components thereof which may possibly be utilized or adapted for use in at least one possible embodiment may possibly be found in the following U.S. Patents: U.S. Pat. No. 4,964,260, entitled "Packaging machine for cardboard boxes and process for packaging articles in cardboard boxes;" U.S. Pat. No. 4,785,610, entitled "Automatic machine for packaging products of different kinds in boxes;" U.S. Pat. No. 5,265,398, entitled "Automatic counting and boxing machine;" U.S. Pat. No. 5,943,847, entitled "Packaging machine for multi-packs;" U.S. Pat. No. 5,937,620, entitled "Packaging machine for multi-packs;" U.S. Pat. No. 5,711,137, entitled "Packaging machine and method of packaging articles;" and U.S. Pat. No. 5,706,633, entitled "Packaging machine and method of packaging articles."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the application described herein above in the context of the preferred embodiments are not to be taken as limiting the embodiments of the application to all of the provided details thereof, since modifications and variations thereof may be made without departing from the spirit and scope of the embodiments of the application.

What is claimed is:

1. A beverage can filling plant for filling beverage cans with liquid beverage material, said beverage can filling plant comprising:

a beverage can cleaning machine being configured and disposed to clean empty beverage cans;

a feed arrangement to supply empty beverage cans to said beverage can cleaning machine;

a beverage filling machine being configured and disposed to fill empty beverage cans with liquid beverage material;

said beverage filling machine comprising a plurality of beverage filling devices for filling beverage cans with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move empty beverage cans from said beverage can cleaning machine into said beverage filling machine;

said first conveyer arrangement comprising a star wheel structure;

a beverage can closing machine being configured and disposed to close tops of filled beverage cans;

a second conveyer arrangement being configured and disposed to move filled beverage cans from said beverage filling machine into said beverage can closing machine;

said second conveyer arrangement comprising a star wheel structure;

a beverage can packaging station being configured and disposed to package filled, closed beverage cans;

a third conveyor arrangement being configured and disposed to move filled, closed beverage cans from said beverage can closing machine into said beverage can packaging station;

said third conveyer arrangement comprising a linear conveyor structure being configured and disposed to arrange beverage cans in groups; and said beverage can packaging station comprising:

a dispenser hopper being configured and disposed to hold a supply of folded-flat dividers for dividing groups of beverage cans;

a transfer device being configured and disposed to retrieve and open folded-flat dividers from said dispenser hopper;

said transfer device being configured and disposed to transfer opened dividers into a transfer position above said linear conveyor;

a divider delivery device being configured and disposed to receive opened dividers from said transfer device at the transfer position; and said divider delivery device being configured and disposed to deliver and guide an opened divider into spaces between individual beverage cans in a corresponding group of beverage cans to divide the individual beverage cans, which spaces are minimized but sufficient to permit an opened divider to slide therein;

the minimum distance between the rows of cans is at least equal to the thickness of the material of the cell dividers;

a guide is located between the rows of cans;

the width of the guide is essentially equal to the minimum distance between the rows of cans; and one of:

the guides have a cavity which holds the cell dividers at least partly; and the guides have a closed surface on their upper edge which forms a guide track for the cell dividers.

2. A beverage can filling plant as claimed in claim 1, wherein the changes in height of the upper edges of the guides that occur in the direction of transport limit the insertion movement of the cell dividers; and the guides extend along the transport line, at least from the beginning of the feeding and/or placement of the cell divider to or on the group of cans, until the cell divider is sufficiently inserted into the group of cans.

3. Apparatus for the manufacture of container packages and for the packing of containers such as bottles, cans and similar objects in outer boxes with separating inserts or cell dividers that can be inserted between the containers, which cell dividers can be extracted from a storage magazine and can be inserted into the spaces in a group of containers, whereby the containers are arranged in rows in the packing machine, characterized in that the individual rows of containers of a group of containers to which the cell dividers (13) are to be fed are placed at a minimum distance from one another, then the cell dividers (13) are fed to the group of containers, and then the components of the cell dividers (13) oriented in the direction of transport are inserted into the minimum distance created between the rows of containers, said apparatus comprises:

a transport level for the transport of bottles, cans and similar containers (14), a device for the preparation of cell dividers (13) and a device for the delivery of the cell dividers (13) into the transfer position above the group of containers that comprises rows and is transported through a packing machine, characterized in that the individual rows of containers, at least in the area in which the cell dividers (13) are delivered to the group of containers and/or of the insertion of the cell dividers (13) into the group of containers, are arranged at a minimum distance from one another, wherein the minimum distance between the rows of containers is at least equal to the thickness of the material of the cell dividers (13);

a guide (15) located between the rows of containers, wherein the width of the guide (15) is essentially equal to the minimum distance between the rows of containers; and one of:

the guides (15) have a cavity which holds the cell dividers (13) at least partly; and the guides (15) have a closed surface on their upper edge, which forms a guide track (17) for the cell dividers (13).

4. The apparatus as claimed in claim 3, wherein the changes in height of the upper edges of the guides (15) that occur in the direction of transport limit the insertion movement of the cell dividers (13); and the guides (15) extend along the transport line, at least from the beginning of the feeding and/or placement of the cell divider (13) to or on the group of containers, until the cell divider (13) is sufficiently inserted into the group of containers.

* * * * *